US008470415B2

(12) United States Patent
Simpson et al.

(10) Patent No.: US 8,470,415 B2
(45) Date of Patent: Jun. 25, 2013

(54) TRANSPARENT INK-JET RECORDING FILM

(75) Inventors: Sharon M. Simpson, Lake Elmo, MN (US); James B. Philip, Jr., Mahtomedi, MN (US); John D. Szafraniec, Bloomington, MN (US)

(73) Assignee: Carestream Health, Inc., Rochester, NY (US)

( * ) Notice: Subject to any disclaimer, the term of this patent is extended or adjusted under 35 U.S.C. 154(b) by 7 days.

(21) Appl. No.: 13/176,788

(22) Filed: Jul. 6, 2011

(65) Prior Publication Data

US 2012/0009365 A1 Jan. 12, 2012

Related U.S. Application Data

(63) Continuation-in-part of application No. 13/117,214, filed on May 27, 2011.

(60) Provisional application No. 61/363,359, filed on Jul. 12, 2010, provisional application No. 61/379,856, filed on Sep. 3, 2010, provisional application No. 61/386,081, filed on Sep. 24, 2010.

(51) Int. Cl.

| | |
|---|---|
| ***B41M 5/40*** | (2006.01) |
| ***B41M 5/52*** | (2006.01) |
| ***B41M 5/50*** | (2006.01) |

(52) U.S. Cl.

CPC ..... *B41M 5/52* (2013.01); *B41M 5/506* (2013.01); *B41M 5/5218* (2013.01); *B41M 5/5254* (2013.01)

USPC ..... 428/32.13; 428/32.24; 428/32.25; 428/32.26; 428/32.28; 428/32.31; 428/32.34

(58) Field of Classification Search

CPC ..... B41M 5/52; B41M 5/506; B41M 5/5218; B41M 5/5254

USPC ..... 428/32.13, 32.24, 32.25, 32.26, 32.28, 428/32.31, 32.34; 427/243; 347/105

See application file for complete search history.

(56) References Cited

U.S. PATENT DOCUMENTS

| | | | | |
|---|---|---|---|---|
| 4,592,951 | A | 6/1986 | Viola | |
| 4,877,686 | A | 10/1989 | Riou et al. | |
| 5,795,708 | A | 8/1998 | Boutet | |
| 6,387,473 | B1 * | 5/2002 | Sismondi et al. | 428/32.34 |
| 6,623,819 | B2 | 9/2003 | Missell et al. | |
| 6,630,283 | B1 | 10/2003 | Simpson et al. | |
| 6,908,191 | B2 | 6/2005 | Liu et al. | |
| 2003/0064208 | A1 * | 4/2003 | Yamada et al. | 428/195 |
| 2004/0022968 | A1 | 2/2004 | Liu et al. | |
| 2004/0027440 | A1 * | 2/2004 | Baker et al. | 347/105 |
| 2007/0231510 | A1 * | 10/2007 | Baker | 428/32.28 |
| 2008/0057232 | A1 * | 3/2008 | Leon et al. | 428/32.24 |
| 2010/0033527 | A1 | 2/2010 | Kawakami et al. | |

FOREIGN PATENT DOCUMENTS

| | | |
|---|---|---|
| EP | 1 346 840 | 9/2003 |
| EP | 1 369 254 | 12/2003 |
| EP | 1 386 751 | 2/2004 |

OTHER PUBLICATIONS

International Search Report, mailed on Sep. 26, 2011, for International Patent Application No. PCT/US2011/043120, 3 pages.

* cited by examiner

*Primary Examiner* — Betelhem Shewareged

(57) ABSTRACT

Addition of a surfactant to either the under-layer, the image-receiving layer, or to both the under-layer and the image-receiving layer provides a quick-drying, transparent ink-jet recording film capable of achieving an optical density of at least 2.8 while still having a low haze and producing a number of grey levels.

17 Claims, No Drawings

TRANSPARENT INK-JET RECORDING FILM

CROSS REFERENCE TO RELATED APPLICATIONS

This application is a continuation-in-part of U.S. patent application Ser. No. 13/117,214, filed May 27, 2011 by Simpson et al., entitled TRANSPARENT INK-JET-RECORDING FILM, which claims priority from U.S. Provisional Patent Application Ser. No. 61/363,359, filed Jul. 12, 2010 by Simpson et al., entitled TRANSPARENT INK-JET RECORDING FILM, both of which are hereby incorporated by reference in their entirety.

This application also claims priority from U.S. Provisional Patent Application Ser. No. 61/363,359, filed Jul. 12, 2010 by Simpson et al., entitled TRANSPARENT INK-JET RECORDING FILM.

This application also claims priority from U.S. Provisional Patent Application Ser. No. 61/379,856, filed Sep. 3, 2010 by Simpson et al., entitled TRANSPARENT INK-JET RECORDING FILMS, COMPOSITIONS, AND METHODS.

This application also claims priority from U.S. Provisional Patent Application Ser. No. 61/386,081, filed Sep. 24, 2010 by Simpson et al., entitled TRANSPARENT INK-JET RECORDING FILMS, COMPOSITIONS, AND METHODS.

Each of the above is hereby incorporated by reference in its entirety.

FIELD OF THE INVENTION

This invention relates to improved ink-jet recording films coated on transparent supports, to methods of preparing these films, and to methods of imaging and using these films. These films are particularly useful for medical imaging applications.

BACKGROUND

In a typical ink-jet recording or printing system, ink droplets are ejected from a nozzle at high speed towards a recording film, element, or medium to produce an image on the film. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink-jet recording film typically comprises a support having on at least one surface thereof an ink-receiving or image-forming layer, and includes those intended for reflection viewing, which have an opaque support, and those intended for viewing by transmitted light, which have a transparent support.

In order to achieve and maintain photographic-quality images on such an image-recording film, an ink-jet recording film must:

Be readily wetted so there is no puddling, i.e., coalescence of adjacent ink dots, which leads to non-uniform density.

Exhibit no image bleeding.

Exhibit the ability to absorb high concentrations of ink and dry quickly to avoid films blocking together when stacked against subsequent prints or other surfaces.

Exhibit no discontinuities or defects due to interactions between the support and/or layer(s), such as cracking, repellencies, comb lines and the like.

Not allow unabsorbed dyes to aggregate at the free surface causing dye crystallization, which results in bloom or bronzing effects in the imaged areas.

Have an optimized image fastness to avoid fade from contact with water or radiation by daylight, tungsten light, or fluorescent light.

In addition, a transparent ink-jet recording film suitable for medical imaging output must provide:

A transparent maximum optical density of at least about 2.8.

A grey scale sufficient to distinguish among the densities of various body structures.

A haze value at least that of current medical X-ray films (i.e., about 26 or less).

An ink-jet recording film that simultaneously provides an almost instantaneous ink dry time and good image quality is desirable. However, given the wide range of ink compositions and ink volumes that an ink-jet recording film needs to accommodate, these requirements are difficult to achieve simultaneously.

Ink jet recording films are known that employ porous or non-porous single layer or multilayer coatings that act as suitable image-receiving layers on one or both sides of a porous or non-porous support. Recording films that use non-porous coatings typically have good image quality but exhibit poor ink dry time. Recording films that use porous coatings typically contain colloidal particulates and have poorer image quality but exhibit superior dry times.

While a wide variety of porous image-recording films for use with ink-jet printing are known, there are many unsolved problems in the art and many deficiencies in known products which have severely limited their commercial usefulness.

A challenge in the design of a transparent porous ink-receiving layer for ink jet films is providing high quality, crack-free coatings with as little non-particulate matter as possible. If too much non-particulate matter is present, the image-recording layer will not be porous and will exhibit poor ink dry times. If too much particulate matter is present, the image recording layer will have a high level of haze or will exhibit cracking.

An additional challenge in preparing transparent ink-jet recording films is providing images having high density. Typical ink-jet films use a reflective backing. In these films, a high density image is achieved because light is absorbed as it passes into the imaged film and again, upon reflection, as it passes out of the film. For transparent films, such as those used to record medical X-rays, the high density image must be achieved by laying down a large amount of ink. However, the large amount of ink required leads to slow drying images. To compensate for the slow drying, heaters and/or slow through-put are required.

U.S. Pat. No. 4,877,686 (Riou et al.) describes a recording sheet for ink jet printing wherein boric acid or its derivative is used to cause gelling in a polymeric binder containing hydroxyl groups and a filler comprising particles. However, there is a problem with this recording sheet in that the amount of boric acid used does not provide a recording sheet which, when printed with an ink-jet printer, will have a fast dry time without cracking.

U.S. Patent Application Publication 2004/0022968 (Liu et al.) describes an ink jet recording element comprising a subbing layer comprising a polymeric binder and a borate and an image-receiving layer comprising a cross-linkable polymer and inorganic particles. Surfactants are present in the image-receiving layer at up to about 0.5 wt %.

U.S. Pat. No. 6,908,191 (Liu et al.) describes an ink jet printing method. A coating aid may be present in the image-receiving layer of from 0.01 to 0.30 wt % based on the total solution weight.

U.S. Pat. No. 6,623,819 (Missell et al.) describes an ink jet recording element. A coating aid may be present in the image-receiving layer of from 0.01 to 0.30 wt % based on the total solution weight.

Problem to be Solved

There is a need for an ink jet recording film that has a fast dry time when used in ink-jet printing of medical images on a transparent support. There is a further need for an ink-jet recording film that has good coating quality, and particularly no mud-cracking of the ink-receiving layer. There is a further need for an ink-jet recording film useful for medical imaging that exhibits high maximum density, low haze, and is capable of recording a sufficient number of grey levels to enable a radiologist to distinguish among various organs and the of tissues having different density.

SUMMARY OF THE INVENTION

In one embodiment, the invention provides an ink-jet recording film comprising: a transparent support; and an under-layer comprising, a water soluble or water dispersible cross-linkable polymer containing hydroxyl groups, a borate, and optionally a surfactant; an image-receiving layer coated over the under-layer comprising, a water soluble or water dispersible cross-linkable polymer containing hydroxyl groups, inorganic particles, and optionally a surfactant; with the proviso that at least one of the under-layer or image-receiving layer contains a surfactant in an amount of at least 0.5 wt % when in the under-layer and at least 0.2 wt % when in the image receiving layer.

In another embodiment, the invention provides an ink-jet recording film wherein: the transparent support is polyethylene terephthalate; the under-layer comprises polyvinyl alcohol, the borate comprises sodium tetraborate decahydrate, and the surfactant comprises p-isononylphenoxypoly(glycidol); and, the image-receiving layer comprises polyvinyl alcohol, the inorganic particles comprise boehmite alumina, and the surfactant comprises p-isononylphenoxypoly-(glycidol).

In a further embodiment, the invention provides a method of preparing an ink-jet recording film comprising, coating onto a transparent support; an under-layer comprising, a water soluble or water dispersible cross-linkable polymer containing hydroxyl groups, a borate, and optionally a surfactant; and an image-receiving layer coated over the under-layer comprising, a water soluble or water dispersible cross-linkable polymer containing hydroxyl groups, inorganic particles, and optionally a surfactant; with the proviso that at least one of the under-layer or image-receiving layer contains a surfactant in an amount of at least 0.5 wt % when in the under-layer and at least 0.2 wt % when in the image receiving layer; and drying the coated recording film.

In yet another embodiment, the invention provides a method of forming an image comprising printing with an ink-jet onto the transparent ink-jet recording film described above.

Other aspects, advantages, and benefits of the present invention are apparent from the detailed description, examples, and claims provided in this application.

DETAILED DESCRIPTION OF THE INVENTION

U.S. patent application Ser. No. 13/117,214, filed May 27, 2011 by Sharon M. Simpson et al., entitled TRANSPARENT INK-JET-RECORDING FILM; U.S. Provisional Patent Application Ser. No. 61/363,359, filed Jul. 12, 2010 by Sharon M. Simpson et al., entitled TRANSPARENT INK-JET RECORDING FILM; U.S. Provisional Patent Application Ser. No. 61/379,856, filed Sep. 3, 2010 by Sharon M. Simpson et al., entitled TRANSPARENT INK-JET RECORDING FILMS, COMPOSITIONS, AND METHODS; U.S. Provisional Patent Application Ser. No. 61/386,081, filed Sep. 24, 2010 by Sharon M. Simpson et al., entitled TRANSPARENT INK-JET RECORDING FILMS, COMPOSITIONS, AND METHODS, is each incorporated by reference in its entirety.

Applicants have noted that the addition of a surfactant to either the under-layer, the image-receiving layer, or to both the under-layer and the image-receiving layer provides a quick-drying, crack-free, transparent ink-jet recording film capable of achieving an optical density of at least 2.8, a haze of less than 26, and a large number of grey levels.

DEFINITIONS

As used herein:

The terms "a" or "an" refer to "at least one" of that component (for example, the ink-jet inks, polymers, and surfactants described herein). Thus the term "an ink-receptive coating can refer to a coating capable of receiving one or more inks.

The terms "under-layer" or "buried layer" indicate that there is at least one other layer disposed over the layer (such as a "buried" "under-layer").

The terms "image-receiving layer" or "topcoat layer" refer to a layer that is coated over the under-layer. Often the image-receiving layer is the outermost layer and serves as the layer that absorbs the ink-jet inks.

The terms "coating weight", "coat weight", and "coverage" are synonymous, and are usually expressed in weight or moles per unit area such as $g/m^2$ or $mol/m^2$.

Unless otherwise indicated, when the terms "ink jet recording film," "ink-jet recording material," "ink-jet recording element" or ink-jet recording article" is used herein, the terms refer to embodiments of the present invention.

The term "transparent" means capable of transmitting visible light without appreciable scattering or absorption.

The term "article" refers to a construction having a coating of one or more "ink-receiving layers" on a transparent support.

The term "immediately after imaging" refers to the point at which the trailing edge of the imaged film exits the printer.

"Haze" is wide-angle scattering that diffuses light uniformly in all directions. It is the percentage of transmitted light that deviates from the incident beam by more than 2.5 degrees on the average. Haze reduces contrast and results in a milky or cloudy appearance. The lower the haze number, the less hazy the material.

The term "aqueous solvent" means water is present in the greatest proportion in a homogeneous solution as liquid component.

The term "water soluble" means the solute forms a homogenous solution with water, or a solvent mixture in which water is the major component.

"Simultaneous coating" or "wet-on-wet" coating means that when multiple layers are coated, subsequent layers are coated onto the initially coated layer before the initially coated layer is dry. Simultaneous coating can be used to apply layers on the frontside, backside, or both sides of the support.

The terms "frontside" and "backside" of the film refer to the "first and second major surfaces" respectively. In the ink-jet recording films described herein that are coated onto a transparent support, the ink-receiving coatings and under-layer coated onto the frontside (first major surface) of the support.

The terms "front" and "back" refer to layers, films, or coatings nearer to and farther from, respectively, the source of the ink-jet inks.

*Research Disclosure* is published by Kenneth Mason Publications, Ltd., The Book Barn, Westbourne, Hampshire, PO10 8RS, UK. The publication is also available from Research Disclosure, 145 Main Street, Ossining, N.Y. 10562 (www.researchdisclosure.com).

Furthermore, all publications, patents, and patent documents referred to in this document are incorporated by reference herein in their entirety, as though individually incorporated by reference.

The Under-Layer

The under-layer comprises a water soluble or water dispersible cross-linkable polymer containing cross-linkable hydroxyl groups, a borate, and optionally may contain a surfactant.

The water soluble or water dispersible cross-linkable polymeric binder containing hydroxyl groups employed in the under-layer may be, for example, poly(vinyl alcohol), partially hydrolyzed poly(vinyl acetate/vinyl alcohol), copolymers containing hydroxyethylmethacrylate, copolymers containing hydroxyethylacrylate, copolymers containing hydroxypropyl-methacrylate, and hydroxy cellulose ethers such as hydroxyethylcellulose. In a specific embodiment, the cross-linkable polymer containing hydroxyl groups is poly (vinyl alcohol). Mixtures of these cross-linkable hydroxyl group containing polymers may be used if desired.

The polymeric binder for the under-layer is preferably used in an about up to about 1.8 g/m$^2$. Or the polymeric binder for the under-layer may be used in an amount from about 0.02 to about 1.8 g/m$^2$, or from about 0.25 to about 2.0 g/m$^2$.

The borate or borate derivative employed in the under-layer of the ink-jet recording element employed in the invention may be, for example, sodium borate, sodium tetraborate, sodium tetraborate decahydrate, boric acid, phenyl boronic acid, or butyl boronic acid, or mixtures thereof. The borate or borate derivative is used in an amount of up to about 2 g/m$^2$. In at least some embodiments, the ratio of the borate or borate derivative to the polymeric binder may be, for example, between about 25:75 and about 90:10 by weight, or the ratio may be about 66:33 by weight. While not wishing to be bound by theory, it is believed that upon coating, a portion of the borate or borate derivative in the under-layer diffuses into the image-receiving layer to cross-link at least a portion of the cross-linkable binder in the image-receiving layer.

The optional surfactant is a p-isononylphenoxypoly(glycidol), a fluoroaliphatic polyacrylate fluoropolymer, or a hydroxyl terminated fluorinated polyether, or mixtures thereof.

In one embodiment, the surfactant is generally present in the under-layer in an amount of from about 0.001 g/m$^2$ to about 0.10 g/m$^2$ or greater than 0.5 weight % of total dry solids.

In one a particular embodiment, the under-layer comprises a poly(vinyl alcohol) polymer, borax, and a surfactant.

In one embodiment, the solids coating weight for the under-layer is coated in an amount of from 0.25 g/m$^2$ to 2.0 g/m$^2$. In another embodiment, the polymeric binder for the under-layer is coated in an amount of from about 0.02 g/m$^2$ to about 1.8 g/m$^2$.

The Image-Receiving Layer

The image-receiving layer comprises, a water soluble or water dispersible cross-linkable polymer containing hydroxyl groups, inorganic particles, and a surfactant.

The water soluble or water dispersible cross-linkable polymer containing hydroxyl groups employed in the image-receiving layer may be, for example, poly(vinyl alcohol), partially hydrolyzed poly(vinyl acetate/vinyl alcohol), copolymers containing hydroxyethylmethacrylate, copolymers containing hydroxyethylacrylate, copolymers containing hydroxypropyl-methacrylate, and hydroxy cellulose ethers such as hydroxyethylcellulose. In a specific embodiment, the cross-linkable polymer containing hydroxyl groups is poly(vinyl alcohol).

The amount of binder used in the image-receiving layer should be sufficient to impart cohesive strength to the ink jet recording element, but should also be minimized so that the interconnected pore structure formed by the particles is not filled in by the binder. This prevents "mud cracking" from occurring upon drying of the film either during coating or imaging.

The polymeric binder for the image-receiving layer is preferably used in an amount of from about 1.0 g/m$^2$ to about 4.5 g/m$^2$.

The inorganic particles include, for example, metal oxides, hydrated metal oxides, boehmite alumina, clay, calcined clay, calcium carbonate, aluminosilicates, zeolites, or barium sulfate. In a preferred embodiment, the metal oxide is silica, alumina, zirconia, or titania. In another preferred embodiment, the metal oxide is fumed silica, fumed alumina, colloidal silica, boehmite alumina, or mixtures thereof. In one embodiment, the inorganic particles are generally present in the image-receiving layer in an amount of up to about 50 g/m$^2$.

When the inorganic particles are fumed silica or fumed alumina, they preferably have a primary particle size up to about 50 nm, but can be aggregated to give an aggregate size of less than about 300 nm. When the inorganic particles are colloidal silica or boehmite, they preferably have a particle size of less than about 150 nm.

A particularly useful inorganic particle is a dispersible boehmite alumina powder with high porosity (HP) and a particle size of about 140 nm. When preparing an image-receiving layer coating mix comprising such a boehmite alumina powder, it may be useful to first prepare a composition comprising the boehmite alumina powder, water, and optionally the surfactant. The composition may then be combined with the binder and optionally other ingredients to form the image-receiving layer coating mix.

The pH of such a composition may, in some cases, be lowered using an acid, such as, for example, nitric acid. The pH may be lowered, for example, to about 3.25, or below about 3.25, or below about 3.09, or below about 2.73, or between about 2.17 and about 2.73. During preparation, such a composition may, for example, be heated to a temperature of at least about 80° C. In some cases, such a composition may be mixed using, for example, one or more eductors.

Such preparation procedures are described in more detail in U.S. Provisional Patent Application Ser. No. 61/379,856, filed Sep. 3, 2010 by Sharon M. Simpson et al., entitled TRANSPARENT INK-JET RECORDING FILMS, COMPOSITIONS, AND METHODS; U.S. Provisional Patent Application Ser. No. 61/386,081, filed Sep. 24, 2010 by Sharon M. Simpson et al., entitled TRANSPARENT INK-JET RECORDING FILMS, COMPOSITIONS, AND METHODS; and U.S. Provisional Patent Application Ser. No. 61/388,784, filed Oct. 1, 2010 by William Ruzinsky et al., entitled TRANSPARENT INK-JET RECORDING FILMS, COMPOSITIONS, AND METHODS, each of which is hereby incorporated by reference in its entirety.

The surfactant is a p-isononylphenoxypoly(glycidol), a fluoroaliphatic polyacrylate fluoropolymer, or a hydroxyl terminated fluorinated polyether.

In one embodiment, the surfactant is generally present in the image-receiving layer in an amount of up to about 1.5 $g/m^2$ or at least about 0.20 wt % of total dry solids. In another embodiment, the surfactant is generally present in the image-receiving layer in an amount of at least 0.50 wt % of total dry solids.

In another embodiment, the surfactant is present in both the under-layer and the image-receiving layer in a total amount of at least 0.7 wt %. Preferably the under-layer contains 0.75 wt % of surfactant and the image-receiving layer contains 0.50 wt %. More preferably the under layer contains 1 wt % and the image-receiving layer contains 0.60 wt % of total dry solids.

In one particular embodiment, the image-receiving layer comprises a poly(vinyl alcohol) polymer, a dispersible boehmite alumina, and a surfactant.

In one embodiment, the image-receiving layer comprises a polyvinyl alcohol, the inorganic particles comprise at least 88 wt %, and the surfactant comprises at least 0.20 wt %. In another embodiment, the ratio of inorganic particles to cross-linkable hydroxyl containing polymer is between 90:10 and 95:5. In another embodiment, the ratio of inorganic particles to cross-linkable hydroxyl containing polymer is between 90:10 and 95:5 and the surfactant comprises at least about 0.20 wt %. In a particular embodiment, the ratio of inorganic particles to cross-linkable hydroxyl containing polymer is 92:8 and the surfactant comprises at least about 0.50 wt %. In another particular embodiment, the ratio of inorganic particles to cross-linkable hydroxyl containing polymer is polymer is 94:6 and the surfactant comprises at least about 0.27%.

In one embodiment, the image-receiving layer solids coating weight may range from about 20 $g/m^2$ to about 60 $g/m^2$. In another embodiment, the image-receiving layer solids coating weight may range from about 30 $g/m^2$ to about 50 $g/m^2$.

In addition to the image-receiving layer, the recording element employed in the invention may also contain a layer on top of the image-receiving layer, the function of which is to increase gloss. Materials useful for this layer include sub-micron inorganic particles and/or polymeric binder.

Backside Layers

While the under-layer and ink-jet image-receiving layers can be coated on one side of the transparent film support, manufacturing methods can also include forming on the opposing or backside of the polymeric support, one or more additional layers, including a conductive layer, a dye or pigment layer, or a layer containing a matting agent (such as silica), an anticurl layer, or a combination of such materials in one or more layers.

Support Materials:

The ink-jet recording films comprise a polymeric support that is preferably a flexible, transparent film that has any desired thickness and is composed of one or more polymeric materials. The support is required to exhibit dimensional stability during printing and storage, and to have suitable adhesive properties with overlying layers. Useful polymeric materials for making such supports include polyesters [such as poly(ethylene terephthalate) and poly(ethylene naphthalate)], cellulose acetate and other cellulose esters, polyvinyl acetal, polyolefins, polycarbonates, and polystyrenes. Preferred supports are composed of polymers having good dimensional stability, such as polyesters and polycarbonates.

Also useful are transparent, multilayer, polymeric supports comprising numerous alternating layers of at least two different polymeric materials as described in U.S. Pat. No. 6,630,283 (Simpson et al.). Another support comprises dichroic mirror layers as described in U.S. Pat. No. 5,795,708 (Boutet).

Support materials can contain various colorants, pigments, dyes or combinations thereof to optimize the color and tone of the image and that of the desired background. For example, the support can include one or more dyes that provide a blue color in the resulting imaged film. Alternatively, the support can be colorless and the color and tone of the image and any desired background color can be optimized by the inks. A combination of these techniques can be used.

Support materials may be treated using conventional procedures (such as corona discharge) to improve adhesion of overlying layers, or under-layers, or other adhesion-promoting layers can be used. For medical imaging applications, addition of a blue tinting dye to the support is particularly useful.

A particularly useful support is 7 mil (178 micron) blue tinted polyethylene terephthalate (PET).

Coating and Drying

The under-layer and image-receiving layer coating compositions can be coated either from water or organic solvents, however water is preferred. The total solids content should be selected to yield a useful coating thickness in the most economical way.

The layers can be coated one at a time, or two or more layers can be coated simultaneously. For example, simultaneously with application of the under-layer formulation to the support, the image-receiving layer is applied simultaneously to the film support using slide coating, the first layer being coated on top of the second layer while the second layer is still wet, using the same or different solvents.

The layers of the ink-jet formulations described herein may be coated by any number of well known techniques, including dip-coating, wound-wire rod coating, doctor blade coating, air knife coating, gravure roll coating, and reverse-roll coating, slide coating, bead coating, extrusion coating, curtain coating and the like. Known coating and drying methods are described in further detail in *Research Disclosure* no. 308119, published December 1989, pages 1007 to 1008. Slide coating is preferred, in which the base layers and overcoat may be simultaneously applied. The choice of coating process would be determined from the economics of the operation and in turn, would determine the formulation specifications such as coating solids, coating viscosity, and coating speed.

After coating, the ink-jet recording films are generally dried by simple evaporation, which may be accelerated by known techniques such as convection heating.

The following examples are provided to illustrate the practice of the present invention and the invention is not meant to be limited thereby.

Materials and Methods for the Experiments and Examples:

All materials used in the following examples are readily available from standard commercial sources, such as Aldrich Chemical Co. (Milwaukee, Wis.) unless otherwise specified. All percentages are by weight unless otherwise indicated. The following additional methods and materials were used.

Boehmite is an aluminium oxide hydroxide ($\gamma$-AlO(OH)).

Borax is sodium tetraborate decahydrate.

Celvol poly(vinyl alcohol) 203 is 87-89% hydrolyzed and 13,000 to 23,000 average molecular weight available from Sekisui.

Celvol poly(vinyl alcohol) 540 is 87-89.9% hydrolyzed and 140,000 to 186,000 average molecular weight available from Sekisui Specialty Chemicals America, LLC (Dallas, Tex.).

Disperal HP-14 is a dispersable boehmite alumina powder with high porosity (HP) and a particle size of 140 nm. It is available from Sasol North America Inc. (Houston, Tex.).

DX1060 is a 30% cationic fluorosurfactant, 10% hexylene glycol and 60% water available from Dynax Corp. (Pound Ridge, N.Y.)

Gohsenol GL-03 (Nippon Gohsei Co. Ltd.) polyvinyl alcohol is 86.5-89.0% hydrolyzed.

Gohsenol KH-20 is polyvinyl alcohol 78.5 to 81.5% hydrolyzed (Nippon Gohsei Co. Ltd.).

Masurf® FP-230 is 30% fluoroaliphatic polyacrylate fluoropolymer in 9.0% dipropyl glycol and 61% water and is a cationic surfactant available from Mason Chemical Co. (Arlington Heights, Ill.).

Masurf® FP-320 is 22% fluoroaliphatic urethane in 5.0% glycol, 10.0% ethylsuccinate and 63% water and is a cationic surfactant available from Mason Chemical Co. (Arlington Heights, Ill.).

Masurf® FP-420 is 20% fluoroacrylate copolymer in 7.0% dipropyl glycol and 73% water and is a cationic surfactant available from Mason Chemical Co. (Arlington Heights, Ill.).

Masurf® FS-810 is 11% fluoroaliphatic polyacrylate in 26.0% dipropyl glycol and 63.0% water and a non-ionic surfactant available from Mason Chemical Co. (Arlington Heights, Ill.).

Masurf®, SP-320 is 20% fluoroacrylate copolymer in 80% water and is a cationic surfactant available from Mason Chemical Co. (Arlington Heights, Ill.).

PET is polyethylene terephthalate and is a support for the ink jet receptor coatings. The terms support, substrate, and film base are used interchangeably.

PF-159 is 100% hydroxy terminated fluorinated polyether. It is a non-ionic surfactant from BASF Chemical Co. (Florham Park, N.J.).

Surfactant 10G is p-isononylphenoxypoly(glycidol). It is also known as Olin 10G. It is available from Dixie Chemical Co. (Houston, Tex.).

Zonyl® 8740 is 30% perfluoro methylacrylic copolymer dispersion in 70% water available from DuPont Chemical Solutions Enterprise (Wilmington, Del.).

Zonyl® FS-300 is 40% fluoroacrylic alcohol substituted polyethylene glycol in 60% water available from DuPont Chemical Solutions Enterprise (Wilmington, Del.).

Zonyl® FSN is 40% non-ionic fluorosurfactant in 30% isopropyl alcohol and 30% water available from DuPont Chemical Solutions Enterprise (Wilmington, Del.).

Imaging of Samples

Samples were imaged with an Epson 7900 ink-jet printer using a Wasatch Raster Image Processor (RIP). A grey scale image was created by a combination of photo black, light black, light light black, magenta, light magenta, cyan, light cyan, and yellow Epson inks supplied with the ink jet printer. Samples were printed with a 17 step grey scale wedge with a maximum Optical Density of at least 2.8. The percent of the patch at an optical density of at least 2.8 was evaluated less than 5 seconds after the sheet exited the printer.

Optical Density (OD) of each sample was measured using a calibrated X-Rite Model DTP 41 Spectrophotomer (X-Rite Inc. Grandville, Mich.) in transmission mode.

Measurement of Drying of Ink

A sheet of film was imaged using an ink-jet printer configured to produce 17 step grey scale wedges. Immediately after the film exited the printer, the ink-jet image turned over and held above a piece of white paper. The percent of wet ink on the step having the maximum density was graded on a scale of 0 (completely dry) to 100 (the ink on the rectangle was completely wet). It is preferred that the portion of the film having an optical density of at least 2.8 is substantially dry (i.e., has a wetness value of no more than 25%, less than 5 seconds after imaging. It is more preferred that the portion of the film having a maximum density greater than about 3 has a value of at no more than 75%, less than 5 seconds after imaging.

A sample was considered as inventive if the percent wetness of the sample was less than that of a similarly prepared sample containing no surfactant, so long as the haze value was less than 24%.

Measurement of Haze

Haze (%) was measured in accord with ASTM D 1003 by conventional means using a Haze-gard Plus Hazemeter that is available from BYK-Gardner (Columbia, Md.). Total haze for ink-jet recording film should be as low as possible. It should not be more than 26% and preferably it should not be more than 24%. The haze value of the support is about 2.5±1%. To provide consistent haze measurements, all samples within each Example were coated onto the same lot of support.

Example 1

The following example demonstrates the use of a surfactant in only the image-receiving layer.

Preparation of Under-Layer

A coating solution was prepared by mixing 3.33 g of deionized water, 0.67 g of poly(vinyl alcohol) GL-03 as a 15% aqueous solution and 6.00 g of borax (sodium tetraborate decahydrate) as a 5% aqueous solution. The ratio of borax to poly(vinyl alcohol) was 75:25 by weight. The coating solution was knife coated at room temperature onto a 7 mil (178 micron) polyethylene terephthalate support. The coating was air dried. The dry coating weight of the under-layer was 0.64 $g/m^2$.

Preparation of Image-Receiving Layers

A coating solution for the ink-jet, image-receiving layer (Comparative Example 1-1) was prepared by mixing 34.12 g of Disperal HP-14 (pH adjusted to 3.25 with 70% nitric acid) as a 20% aqueous solution (6.82 g net), and 5.93 g of Gohsenol KH-20 poly(vinyl alcohol) as a 10% aqueous solution (0.593 g net). The finished coating solution was at 17.9% solids. An inventive coating solution, Inventive Example 1-2, was also prepared as described above but 0.60 g of Surfactant 10G as a 10% solution was added (0.06 g net). The finished coating solution was at 18.0% solids. The weight ratio of inorganic particles to polymer was 92:8.

The solutions were knife coated at room temperature onto the under-layers prepared above. Each solution was coated onto each of the under-layers. All coatings were dried in a forced air oven at 85° C. for 10 minutes. No mud-cracking was observed on the dried coatings. The image-receiving layer was coated at 34 $g/m^2$ (using a 10.0 mil (254 micron) knife gap). In all, 2 samples were prepared.

Samples were imaged as described above. TABLE I, shows the percent by weight of surfactant added to the coating, the type of surfactant added to the ink-jet, image-receiving layer, and the fraction of the patch having an optical density of 3.2 that was still wet 5 seconds after the completion of printing.

The data demonstrates that the addition of 0.80 wt % of Surfactant 10G to the ink-jet, image-receiving layer improved the time to dry the ink patch having an optical density of at least 2.8.

TABLE I

| Sample# | Description | Surfactant Placement | Surfactant 10G (wt %)* | Percent of Patch Wet | Density of Wet Patch |
|---|---|---|---|---|---|
| 1-1 | Comparative | — | — | 100 | 3.1*** |
| 1-2 | Inventive | Image-receiving layer | 0.80 | 25 | 3.2 |

*Weight percent of total solids in coating.
***The patch having the next lower optical density of 2.5-2.6 was completely dry.

Example 2

The following example demonstrates the use of a surfactant in only the image-receiving layer.

Preparation of Under-Layer

A coating solution was prepared by mixing 3.84 g of deionized water, 0.88 g of GL-03 poly(vinyl alcohol) as a 15% aqueous solution, and 5.28 g of borax (sodium tetraborate decahydrate) as a 5% aqueous solution. The ratio of borax to PVA was 67:33 by weight. The coating solution was knife coated at room temperature onto a 7 mil (178 micron) polyethylene terephthalate support. The coating was air dried. The dry coating weight of the under-layer was 0.64 g/m$^2$.

Preparation of Image-Receiving Layers

A coating solution for the image-receiving layer was prepared by mixing 34.12 g of Disperal HP-14 (pH adjusted to 3.25 with 70% nitric acid) as a 20% aqueous solution (6.82 g net), and 5.93 g of Celvol 540 poly(vinyl alcohol) as a 10% aqueous solution (0.593 g net). The finished coating solution (Comparative Example 2-1) was at 17.9% solids. An additional coating (Comparative Example 2-2) was prepared as described above but 0.30 g of Surfactant 10G as a 10% solution was added. Additional inventive coating solutions were also prepared as described above but 0.50 g of Surfactant 10G (0.05 g net; Example 2-3), 1.00 g Masurf® FP-420 (0.10 g net; Example 2-4), 0.75 g Masurf® FS-810 (0.075 g net; Example 2-5), 0.60 g Masurf® FP-230 (0.060 g net; Example 2-6) as 10% solutions, or 0.53 g Zonyl 8740 as a 30% solution (0.159 g net; Example 2-7) were added. The finished coating solutions were at 18.0%, 18.1%, 18.1%, 18.0% or 18.3% solids, respectively. The weight ratio of inorganic particles to polymer was 92:8.

The solutions were knife coated at room temperature onto the under-layers prepared above. Each solution was coated onto each of the under-layers. All coatings were dried in a forced air oven at 85° C. for 10 minutes. No mud-cracking was observed on the dried coatings. The image-receiving layer was coated at 34 g/m$^2$ (using a 10.0 mil (254 micron) knife gap). In all, 7 samples were prepared.

Samples were imaged as described above. TABLES II and III describe the weight percent of the surfactant added to each coating, the type of surfactant added to the inkjet, image-receiving layer, the fraction of the density patch wet 5 seconds after the completion of printing, and the haze measured on the unprinted coating.

The data, shown below in TABLE III, demonstrate that the addition of 0.67 wt % Surfactant 10G, 1.33 wt % Masurf® FP-420, 1.00 wt % Masurf® FS-810, 0.80 wt % Masurf® FP-230, or 2.1 wt % Zonyl 8740 improved the drying time of the black ink patch that was measured at a transparent optical density of 3.1. The addition of 0.40 wt % Surfactant 10G did not improve the drying time of the inks. Haze was lower with the surfactants Masurf® FP-420 and Masurf® FP-230 as compared to Surfactant 10G Haze was not affected by the addition of the surfactant Zonyl 8740.

TABLE II

| Sample# | Description | Surfactant Placement | Surfactant 10G (wt %)* | Masurf ® FP-420 (wt %)* | Masurf ® FS-810 (wt %)* | Masurf ® FP-230 (wt %*) | Zonyl 8740 (wt %)* |
|---|---|---|---|---|---|---|---|
| 2-1 | Comparative | — | — | — | — | — | — |
| 2-2 | Comparative | Image-receiving layer | 0.40 | — | — | — | — |
| 2-3 | Inventive | Image-receiving layer | 0.67 | — | — | — | — |
| 2-4 | Inventive | Image-receiving layer | — | 1.33 | — | — | — |
| 2-5 | Inventive | Image-receiving layer | — | — | 1.00 | — | — |
| 2-6 | Inventive | Image-receiving layer | — | — | — | 0.80 | — |
| 2-7 | Inventive | Image-receiving layer | — | — | — | — | 2.10 |

*Weight percent of total solids in coating.

TABLE III

| Sample# | Description | Percent of Patch Wet | Density of Wet Patch | Haze |
|---|---|---|---|---|
| 2-1 | Comparative | 100* | 3.1 | 17.9 |
| 2-2 | Comparative | 100* | 3.1 | 20.5 |
| 2-3 | Inventive | 100** | 3.1 | 20.9 |
| 2-4 | Inventive | 100*** | 3.1 | 19.4 |
| 2-5 | Inventive | 100*** | 3.1 | 21.4 |
| 2-6 | Inventive | 100*** | 3.1 | 19.8 |
| 2-7 | Inventive | 50 | 3.1 | 17.7 |

*In addition, 50 percent of the patch having the next lower optical density of 2.5-2.6 was wet.
**Only 25 percent of the patch having the next lower optical density of 2.5-2.6 was wet.
***The patch having the next lower optical density of 2.5-2.6 was completely dry.

Example 3

An under-layer was prepared as described in Example 2. The under-layer did not contain a surfactant.

Preparation of Image-Receiving Layers

Inventive coating solutions for the ink-jet, image-receiving layer were prepared by mixing 41.0 g of Disperal HP-14 (pH adjusted to 3.25 with 70% nitric acid) as a 20% aqueous solution (8.20 g net); 7.13 g of Celvol 540 poly(vinyl alcohol) as a 10% aqueous solution (0.713 g net); and 0.48 g of a 10% Surfactant 10G solution (0.048 g net; Example 3-1), 0.54 g of a 20% Masurf® FP-420 solution (0.108 g net; Example 3-2), 0.74 g of a 11% Masurf® FS-810 solution (0.081 g net; Example 3-3), 0.60 g of a 10% Masurf® FP-230 solution (0.06 g net; Example 3-4) or 0.55 g Zonyl 8740 of a 30% solution (0.165 g net; Example 3-5) were added. The finished coating solutions contained 18.0%, 18.1%, 18.1%, 18.0% or 18.2% solids, respectively. The weight ratio of inorganic particles to polymer was 92:8.

The solutions were knife coated at room temperature onto the under-layers prepared above. Each solution was coated onto each of the under-layers. All coatings were dried in a forced air oven at 85° C. for 10 minutes. No mud-cracking was observed on the dried coatings. The ink-jet, image-receiving layer was coated at 41 g/m$^2$ (using a 12.0 mil (305 micron) knife gap). In all, 5 samples were prepared.

Samples were imaged as described above. TABLES IV and V describe the weight percent of the surfactant added to each coating, the type of surfactant added to the image-receiving layer, the fraction of the density patch wet 5 seconds after the completion of printing, and the haze measured on the unprinted coating.

The data, shown below in TABLE V, demonstrate that addition of; 0.54 wt % Surfactant 10G, 1.20 wt % Masurf® FP-420, 0.90 wt % Masurf® FS-810, 0.67 wt % Masurf® FP-230, or 1.82 wt % Zonyl 8740 improved the drying time of the ink patch that was measured as a transparent black density of 3.0 to 3.1. In addition, haze was lower with the surfactants Masurf® FP-420, Masurf® FS-810, and Masurf® FP-230 when compared with that of Surfactant 10G. The lowest haze occurred with the addition of the surfactant Zonyl 8740.

TABLE IV

| Sample# | Description | Surfactant Placement | Surfactant 10G (wt %)* | Masurf ® FP-420 (wt %)* | Masurf ® FS-810 (wt %)* | Masurf ® FP-230 (wt %)* | Zonyl 8740 (wt %)* |
|---|---|---|---|---|---|---|---|
| 3-1 | Inventive | Image-receiving layer | 0.54 | | | — | — |
| 3-2 | Inventive | Image-receiving layer | — | 1.20 | — | — | — |
| 3-3 | Inventive | Image-receiving layer | — | — | 0.90 | — | — |
| 3-4 | Inventive | Image-receiving layer | — | — | — | 0.67 | — |
| 3-5 | Inventive | Image-receiving layer | — | — | — | — | 1.82 |

*Weight percent of total solids in coating.

TABLE V

| Sample# | Description | Fraction of Patch Wet | Density of Wet Patch | Haze |
|---|---|---|---|---|
| 3-1 | Inventive | 12.5 | 3.0 | 22.8 |
| 3-2 | Inventive | 12.5 | 3.0 | 21.8 |
| 3-3 | Inventive | 12.5 | 3.1 | 22.5 |
| 3-4 | Inventive | 12.5 | 3.1 | 20.8 |
| 3-5 | Inventive | 12.5 | 3.1 | 18.9 |

TABLE VI

| Sample# | Description | Surfactant Placement | Surfactant 10G (wt %)* | PF-159 (wt %)* | Percent of Patch Wet | Density of Wet Patch |
|---|---|---|---|---|---|---|
| 4-1 | Comparative | — | — | — | 50 | 3.0 |
| 4-2 | Inventive | Image-receiving layer | 0.67 | — | 25 | 3.0 |
| 4-3 | Inventive | Image-receiving layer | — | 0.53 | 25 | 3.0 |

*Weight percent of total solids in coating.

Example 4

An under-layer was prepared as described in as Example 2, except that a 15% solution of Celvol 203 was used instead of GL-03. The under-layer did not contain a surfactant.

Preparation of Image-Receiving Layers

An image-receiving layer was prepared as described in Example 2. Comparative Example 4-1 without surfactant was also prepared as described in Example 2. Inventive Examples 4-2 and 4-3 were prepared as described above except that 0.50 g of Surfactant 10G was added as a 10% solution (0.05 g net) and 0.40 g of a 10% PF-159 solution (0.04 g net) was added as 18.0% solids.

The solutions were knife coated and ink-jet printed upon with density patches as described above.

Samples were imaged as described above. TABLE VI describes the weight percent of the surfactant added to each coating, the type of surfactant added to the image-receiving layer and the fraction of the density patch wet 5 seconds after the completion of printing.

The data, shown below in TABLE VI, demonstrate that the addition of 0.67 wt % Surfactant 10G or 0.53 wt % PF-159 improved the drying time of the ink patch measured at a transparent black density of 3.0.

Example 5

An under-layer was prepared as described in Example 1, except that 15% Celvol 203 was used instead of GL-03. The under-layer did not contain a surfactant.

Preparation of Image-Receiving Layers

An ink-jet, image-receiving layer was prepared as described in Example 3. A comparative example (Example 5-1) without surfactant was also prepared as described in Example 3. Inventive coatings (Examples 5-2, 5-3 and 5-4) were prepared as described above except that 0.66 g of Surfactant 10G was added as a 10% solution (0.066 g net), 0.73 g of Masurf® FP-230 was added as a 10% solution (0.073 g net), and 0.64 g of a 30% Zonyl 8740 solution (0.192 g net) was added. The total percent solids of the coating solutions were 18.0%, 18.0% and 18.3%, respectively. The solutions were knife coated and ink-jet printed upon with density patches as described above. The printing occurred at 56 to 62% relative humidity.

TABLE VII describes the weight percent of surfactant added to each coating, the type of surfactant added to the image-receiving layer, the fraction of the density patch wet 5 seconds after the completion of printing, and the haze measured on the unprinted coating.

The data, shown below in TABLE VII demonstrate that the addition of 0.73 wt % Surfactant 10G, 0.81 wt % Masurf® FP-230, or 2.10 wt % Zonyl 8740 improved the drying time of the ink patch measured at a transparent black density of 2.8-2.9. In addition, haze was lower with the surfactant Masurf® FP-230 when compared to that of Surfactant 10G. Haze was not affected with the addition of the surfactant Zonyl 8740.

TABLE VII

| Sample# | Description | Surfactant Placement | Surfactant 10G (wt %)* | Masurf ® FP-230 (wt %)* | Zonyl 8740 (wt %)* | Percent of Patch Wet | Density of Wet Patch | Haze |
|---|---|---|---|---|---|---|---|---|
| 5-1 | Comparative | — | — | — | — | 100*** | 2.8 | 19.9 |
| 5-2 | Inventive | Image-receiving layer | 0.73 | — | — | 50 | 2.8 | 22.9 |
| 5-3 | Inventive | Image-receiving layer | — | 0.81 | — | 25 | 2.9 | 21.0 |
| 5-4 | Inventive | Image-receiving layer | — | — | 2.10 | 0 | 2.9 | 19.6 |

*Weight percent of total solids in coating.

***The patch having the next lower optical density of 2.5-2.6 was completely dry.

Example 6

The following example demonstrates the use of a surfactant in only the image-receiving layer as well as in both the under-layer and the image-receiving layer.

Preparation of Under-Layers

Coating solutions were prepared by mixing 3.84 g of deionized water, 0.88 g of Celvol 203 poly(vinyl alcohol) as a 15% aqueous solution (0.132 g net) and 5.28 g of borax (sodium tetraborate decahydrate) as a 5% aqueous solution (0.264 g net). The ratio of borax to PVA was 67:33 by weight. The coating solutions were knife coated at room temperature onto a 7 mil (178 micron) polyethylene terephthalate support. The coatings were air dried. The dry coating weights of the under-layers was 0.64 g/m$^2$. Comparative Example 6-1 and Inventive Example 6-3 were coated as described above. Comparative Example 6-2 contained 1.0 wt % of Surfactant 10G. Inventive Examples 6-4 and 6-5 contained 0.50% and 1.0 wt % of Surfactant 10G, respectively. Inventive Examples 6-4 and 6-5 were prepared by adding 0.20 g and 0.40 g of a 1.0% solution of Surfactant 10G to the coating solution described above.

Preparation of Image-Receiving Layers

A coating solution for the image-receiving layer was prepared by mixing 34.12 g of Disperal HP-14 (pH adjusted to 3.25 with 70% nitric acid) as a 20% aqueous solution (6.82 g net), and 5.93 g of Celvol 540 poly(vinyl alcohol) as a 10% aqueous solution (0.593 g net). The finished coating solutions (Comparative Examples 6-1 and 6-2) were at 17.9% solids. Additional inventive coating solutions were also prepared as described above but 0.50 g of a 10% solution of Surfactant 10G was added to Examples 6-3, 6-4, and 6-5. The finished coating solutions were at 18.0% solids. The weight ratio of inorganic particles to polymer was 92:8.

The solutions were knife coated at room temperature onto the under-layers prepared above. Each solution was coated onto each of the under-layers. All coatings were dried in a forced air oven at 85° C. for 10 minutes. No mud-cracking was observed on the dried coatings. The, image-receiving layer was coated at 34 g/m$^2$ (using a 10.0 mil (254 micron) knife gap). In all, 5 samples were prepared.

Samples were imaged as described above. For these samples, printing was carried out at 21% relative humidity. TABLE VIII describes the weight percent of the surfactant added to each coating, the type of surfactant added to the image-receiving layer and the fraction of the density patch wet 5 seconds after the completion of printing.

The data, shown below in TABLE VIII, demonstrate that the addition of 0.67 wt % Surfactant 10G only to the ink-jet, image-receiving layer, or the addition of 1.0 wt % Surfactant 10G to the under-layer and 0.67% wt % Surfactant 10G to the ink-jet, image-receiving layer improved the drying time of the ink patch that was measured as a transparent black density of 3.0. The addition of 0.50 wt % Surfactant 10G to the under-layer alone did not improve the drying time of the inks.

TABLE VIII

| Sample# | Description | Surfactant Placement | Surfactant 10G (wt %)* | Percent of Patch Wet | Density of Wet Patch |
|---|---|---|---|---|---|
| 6-1 | Comparative | — | — | 50 | 3.0 |
| 6-2 | Comparative | Under-Layer | 1.00 | 50 | 3.0 |
| 6-3 | Inventive | Image-receiving layer | 0.67 | 25 | 3.0 |
| 6-4 | Inventive | Under-layer and Image-receiving layer | 0.50/0.67 | 25 | 3.0 |
| 6-5 | Inventive | Under-layer and Image-receiving layer | 1.00/0.67 | 12.5 | 3.0 |

*Weight percent of total solids in coating.

Example 7

The following example demonstrates the use of a surfactant in only the image-receiving layer as well as in both the under-layer and the image-receiving layer.

Preparation of Under-Layer

Coating solutions were prepared by mixing 3.84 g of deionized water, 0.88 g of Celvol 203 poly(vinyl alcohol) as a 15% aqueous solution (0.132 g net), and 5.28 g of borax (sodium tetraborate decahydrate) as a 5% aqueous solution (0.264 g net). The ratio of borax to PVA was 67:33 (2:1) by weight. The coating solutions were knife coated at room temperature onto a 7 mil (178 micron) polyethylene terephthalate support. The coatings were air dried. The dry coating weight of the under-layer was 0.64 g/m$^2$. Comparative Example 7-1 and Inventive Example 7-2 were coated as described above. Inventive Examples 7-3 and 7.4 contained 0.75 wt % and 1.25 wt % of Surfactant 10G, respectively. Inventive Examples 7-3 and 7-4 were prepared by adding 0.30 g and 0.50 g of a 1.0% solution of Surfactant 10G to the coating solution described above.

Preparation of Image-Receiving Layers

A coating solution for the image-receiving layer was prepared by mixing 41.0 g of Disperal HP-14 (pH adjusted to 3.25 with 70% nitric acid) as a 20% aqueous solution (8.2 g net), and 7.13 g of Celvol 540 poly(vinyl alcohol) as a 10% aqueous solution (0.713 g net). The finished coating solution (Comparative Example 7-1) was at 17.9% solids. Additional inventive coating solutions were also prepared as described above but 0.60 g of Olin 10G was added to Examples 7-2, 7-3, and 7.4. The finished coating solutions were at 18.0%. The weight ratio of inorganic particles to polymer was 92:8.

The solutions were knife coated at room temperature onto the under-layers prepared above. Each solution was coated onto each of the under-layers. All coatings were dried in a forced air oven at 85° C. for 10 minutes. No mud-cracking was observed on the dried coatings. The image-receiving layer was coated at 41 g/m$^2$ (using a 12.0 mil (305 micron) knife gap). In all, 4 samples were prepared.

Samples were imaged as described above. For these samples, printing was carried out at 51% to 55% relative humidity. TABLE IX describes the weight percent of surfactant added to each coating, the type of surfactant added to the image-receiving layer and the fraction of the density patch wet 5 seconds after the completion of printing.

The data, shown below in TABLE IX demonstrates that the addition of 0.67 wt % Surfactant 10G to only the image-receiving layer, or the addition of 0.75 wt % or 1.25 wt % of Surfactant 10G to the under-layer and 0.67 wt % of Surfactant 10G to the image-receiving layer improved the drying time of the ink patch that was measured as a transparent black density of 2.9 to 3.0.

TABLE IX

| Sample# | Description | Surfactant Placement | Surfactant 10G (wt %)* | Percent of Patch Wet | Density of Wet Patch |
|---|---|---|---|---|---|
| 7-1 | Comparative | — | — | 100*** | 2.9 |
| 7-2 | Inventive | Image-receiving layer | 0.67 | 75 | 3.0 |
| 7-3 | Inventive | Under-layer and Image-receiving layer | 0.75/0.67 | 50 | 3.0 |
| 7-4 | Inventive | Under-layer and Image-receiving layer | 1.25/0.67 | 50 | 3.0 |

*Weight percent of total solids in coating.

***The patch having the next lower optical density of 2.5-2.6 was completely dry.

Example 8

The following example demonstrates the use of a surfactant in only the image-receiving layer. An under-layer was prepared as described in Example 1.

Preparation of Image-Receiving Layers

A coating solution for the image-receiving layer (Comparative Example 8-1) was prepared by mixing 34.86 g of Disperal HP-14 (pH adjusted to 3.25 with 70% nitric acid) as a 20% aqueous solution (6.972 g net), and 4.45 g of Celvol 540 poly(vinyl alcohol) as a 10% aqueous solution (0.455 g net). The finished coating solution was at 17.9% solids. Inventive Examples 8-2 and 8-3 were prepared as described above but 0.20 g or 0.60 g of Surfactant 10G as a 10% solution were added, respectively (0.02 g net or 0.06 g net respectively). The finished coating solution was at 18.0% solids. The weight ratio of inorganic particles to polymer was 94:6.

The solutions were knife coated at room temperature onto the under-layers prepared above. Each solution was coated onto each of the under-layers. All coatings were dried in a forced air oven at 85° C. for 10 minutes. No mud-cracking was observed on the dried coatings. The image-receiving layer was coated at 34 g/m$^2$ (using a 10.0 mil (254 micron) knife gap). In all, 3 samples were prepared.

Samples were imaged as described above. TABLE X describes the weight percent surfactant added to the coating, the type of surfactant added to the inkjet, image-receiving layer and the fraction of the density patch wet 5 seconds after the completion of printing.

The data, shown below in TABLE X, demonstrates that addition of 0.27 wt % or 0.80 wt % of Surfactant 10G to the image-receiving layer improved the drying time of the ink patch that was measured at a transparent black density of 3.0 to 3.1.

TABLE X

| Sample# | Description | Surfactant Placement | Surfactant 10G (wt %)* | Percent of Patch Wet | Density of Wet Patch |
|---|---|---|---|---|---|
| 8-1 | Comparative | — | — | 100*** | 3.0 |
| 8-2 | Inventive | Image-receiving layer | 0.27 | 50 | 3.1 |
| 8-3 | Inventive | Image-receiving layer | 0.80 | 12.5 | 3.1 |

*Weight percent of total solids in coating.

***The patch having the next lower optical density of 2.5-2.6 was completely dry.

Example 9

The following example demonstrates the use of a surfactant in only the image-receiving layer. An under-layer was prepared as described in Example 1.

Preparation of Image-Receiving Layers

A coating solution for the ink-jet, image-receiving layer (Comparative Example 9-1) was prepared by mixing 34.86 g of Disperal HP-14 (pH adjusted to 3.25 with 70% nitric acid) as a 20% aqueous solution (6.972 g net), and 4.45 g of Celvol 540 poly(vinyl alcohol) as a 10% aqueous solution (0.455 g net). The finished coating solution was at 17.9% solids. Inventive Examples 9-2 and 9-3 were also prepared as described above but 0.30 g or 0.45 g of Surfactant 10G as a 10% solution were added, respectively (0.03 g net and 0.045 g net respectively). The finished coating solutions were at 18.0% solids. Inventive Example 9-4 and 9-5 were prepared as described above but contained 0.75 g of 10% Masurf® FS-810 solution (0.075 g net) and 0.75 g of a 10% Masurf® FP-230 solution (0.075 g net). The finished coating solutions were 18.1% solids. The weight ratio of inorganic particles to polymer was 94:6.

The solutions were knife coated and printed as described in Example 8. In all, 5 samples were prepared.

Samples were imaged as described above. TABLE XI describes the weight percent of surfactant added to the coating, the type of surfactant added to the image-receiving layer, and the percent of the density patch wet 5 seconds after the completion of printing.

The data, shown below in TABLE XI, demonstrates that addition of 0.40 wt % or 0.60 wt % Surfactant 10G, 1.0 wt % of Masurf® FS-810, or 1.0 wt % Masurf® FP-230 to the image-receiving layer improved the drying time of the ink patch that was measured at a transparent black density of 3.0 to 3.1.

TABLE XI

| Sample# | Description | Surfactant Placement | Surfactant 10G (wt %)* | Masurf ® FS-810 (wt %)* | Masurf ® FP-230 (wt %)* | Percent of Patch Wet | Density of Wet Patch |
|---|---|---|---|---|---|---|---|
| 9-1 | Comparative | — | — | — | — | 100** | 3.0 |
| 9-2 | Inventive | Image-receiving layer | 0.40 | — | — | 100*** | 3.1 |
| 9-3 | Inventive | Image-receiving layer | 0.60 | — | — | 25 | 3.0 |
| 9-4 | Inventive | Image-receiving layer | — | 1.00 | — | 50 | 3.1 |
| 9-5 | Inventive | Image-receiving layer | — | — | 1.00 | 100*** | 3.1 |

*Weight percent of total solids in coating.
**In addition, 50 percent of the patch having the next lower optical density of 2.5-2.6 was wet.
***The patch having the next lower optical density of 2.5-2.6 was completely dry.

Example 10

The following example demonstrates the use of a surfactant in only the image-receiving layer. An under-layer was prepared as described in Example 1.

Preparation of Image-Receiving Layers

Ink-jet, image-receiving layers were prepared as described in Example 9 except inventive Examples 10-2, 10-3, 10-4, and 10-5 contained 0.40 g (0.04 g net) or 0.50 g (0.05 g net) of Surfactant 10G 1.20 g (0.12 g net) of Zonyl 8740 or 1.00 g (0.10 g net) of Masurf® FP-420 as 10% solutions, respectively. The finished solutions were 18.0% solids for Examples 10-2 and 10-3, 18.2% solids for Example 10-4, and 18.1% solids for Example 10-5. The weight ratio of inorganic particles to polymer was 94:6.

The solutions were knife coated and ink-jet printed upon as described in Example 8. In all, 5 samples were prepared.

Samples were imaged as described above. TABLE XII describes the weight percent of surfactant added to the coating, the type of surfactant added to the image-receiving layer, and the percent of the density patch wet 5 seconds after the completion of printing.

The data, shown below in TABLE XII, demonstrates that addition of 0.54 wt % or 0.67 wt % of Surfactant 10G, 1.60 wt % of Zonyl 8740, or 1.33 wt % of Masurf® FP-420 to the image-receiving layer decreased drying time the ink-jet patch measured at a transparent black optical density of 2.7 to 3.2.

TABLE XII

| Sample# | Description | Surfactant Placement | Surfactant 10G (wt %)* | Zonyl 8740 (wt %)* | Masurf ® FP-420 (wt %)* | Fraction of Patch Wet | Density of Wet Patch |
|---|---|---|---|---|---|---|---|
| 10-1 | Comparative | — | — | — | — | 100** | 3.1 |
| 10-2 | Inventive | Image-receiving layer | 0.54 | — | — | 50 | 2.9 |
| 10-3 | Inventive | Image-receiving layer | 0.67 | — | — | 25 | 2.8 |
| 10-4 | Inventive | Image-receiving layer | — | 1.60 | — | 100*** | 3.2 |
| 10-5 | Inventive | Image-receiving layer | — | — | 1.33 | 25 | 3.1 |

*Weight percent of total solids in coating.
**In addition, 25 percent of the patch having the next lower optical density of 2.5-2.6 was wet.
***The patch having the next lower optical density of 2.5-2.6 was completely dry.

Example 11

The following example demonstrates the use of a surfactant in only the image-receiving layer. An under-layer was prepared as described in Example 1.

Preparation of Image-Receiving Layers

Ink-jet, image-receiving layers were prepared as described in Example 10 except inventive Example 11-2 contained 0.60 g of Surfactant 10G as a 10% solution (0.06 g net). Comparative Examples 11-3, 11-4 and 11-5 contained 0.60 g (0.06 g net) of DX-1060, Zonyl® FS-300, or Zonyl® FSN as 10% solutions, respectively. The finished solutions were 18.0% solids for all examples.

The solutions were knife coated and dried as described in Example 8. In all, 5 samples were prepared. No mud-cracking was observed on the dried coatings. The weight ratio of inorganic particles to polymer was 94:6.

Samples were imaged as described above. TABLES XIII and XIV describe the weight percent of the surfactant added to each coating, the type of surfactant added to the image-receiving layer, the fraction of the density patch wet 5 seconds after the completion of printing, and the haze measured on the unprinted coating.

The data, shown below in TABLE XIV, demonstrates that addition of 0.80 wt % Surfactant 10G to the image-receiving layer improved the drying time of the black ink patch that was measured at a transparent optical density of 3.1. The addition of 0.80 wt % Zonyl® FS-300 or 0.80% wt % Zonyl® FSN to the image-receiving layer also improved the drying time of the inks but with higher haze than Surfactant 10G. The addition of 0.80 wt % DX1060 showed a dry black ink patch at a transparent optical density of 3.1 but with a very high haze.

TABLE XIII

| Sample# | Description | Surfactant Placement | Surfactant 10G (wt %)* | DX1060 (wt %)* | Zonyl ® FS-300 (wt %)* | Zonyl ® FSN (wt %)* |
|---|---|---|---|---|---|---|
| 11-1 | Comparative | — | — | — | — | — |
| 11-2 | Inventive | Image-receiving layer | 0.80 | — | — | — |
| 11-3 | Comparative | Image-receiving layer | — | 0.80 | — | — |
| 11-4 | Comparative | Image-receiving layer | — | — | 0.80 | — |
| 11-5 | Comparative | Image-receiving layer | — | — | — | 0.80 |

*Weight percent of total solids in coating.

TABLE XIV

| Sample# | Description | Percent of Patch Wet | Density of Wet Patch | Haze |
|---|---|---|---|---|
| 11-1 | Comparative | 100** | 3.1 | 18.1 |
| 11-2 | Inventive | 50 | 3.1 | 20.8 |
| 11-3 | Comparative | 0 | 3.1 | 36.4 |
| 11-4 | Comparative | 25 | 3.1 | 28.1 |
| 11-5 | Comparative | 50 | 3.0 | 24.4 |

**In addition, 50 percent of the patch having the next lower optical density of 2.5-2.6 was wet.

Example 12

The following example demonstrates the use of a surfactant in only the image-receiving layer. An under-layer was prepared as described in Example 1.

Preparation of Image-Receiving Layers

Ink-jet, image-receiving layers were prepared as described in Example 10. Example 12-2 contained 0.20 g (0.02 g net) of Surfactant 10G as a 10% solution. Comparative Examples 12-3 and 12-4 contained 0.20 g (0.02 g) DX-1060 or Zonyl® FS-300 as 10% solutions, respectively. The finished solutions were 17.9% solids for all Examples.

The solutions were knife coated and ink-jet printed upon as described in Example 8. In all, 4 samples were prepared. The weight ratio of inorganic particles to polymer was 94:6.

Samples were imaged as described above. TABLES XV and XVI describe the weight percent of the surfactant added to each coating, the type of surfactant added to the image-receiving layer, the fraction of the density patch wet 5 seconds after the completion of printing, and the haze measured on the unprinted coating.

The data, shown below in TABLE XVI, demonstrates that addition of 0.27 wt % Surfactant 10G to the image-receiving layer improved the drying time of the black ink patch that was measured at a transparent optical density of 3.1. The addition of 0.27 wt % DX1069 to the image-receiving layer also improved the drying time of the inks but with higher haze than Surfactant 10G The addition of 0.27 wt % Zonyl® FS-300 showed only minimally improved drying times of the inks at a transparent optical density of 3.1 but with higher haze than Surfactant 10G.

TABLE XV

| Sample# | Description | Surfactant Placement | Surfactant 10G (wt %)* | DX1060 (wt %)* | Zonyl ® FS-300 (wt %)* |
|---|---|---|---|---|---|
| 12-1 | Comparative | — | — | — | — |
| 12-2 | Inventive | Image-receiving layer | 0.27 | — | — |

TABLE XV-continued

| Sample# | Description | Surfactant Placement | Surfactant 10G (wt %)* | DX1060 (wt %)* | Zonyl ® FS-300 (wt %)* |
|---|---|---|---|---|---|
| 12-3 | Comparative | Image-receiving layer | — | 0.27 | — |
| 12-4 | Comparative | Image-receiving layer | — | — | 0.27 |

*Weight percent of total solids in coating.

TABLE XVI

| Sample# | Description | Percent of Patch Wet | Density of Wet Patch | Haze |
|---|---|---|---|---|
| 12-1 | Comparative | 100** | 3.1 | 18.9 |
| 12-2 | Inventive | 50 | 3.1 | 19.5 |
| 12-3 | Comparative | 50 | 3.1 | 24.0 |
| 12-4 | Comparative | 100 | 3.1 | 21.8 |

**In addition, 25 percent of the patch having the next lower optical density of 2.5 to 2.6 was wet.

Example 13

The following example demonstrates the use of a surfactant in only the image-receiving layer. An under-layer was prepared as described in Example 1.

Preparation of Image-Receiving Layers

Ink-jet, image-receiving layers were prepared as described in Example 10. Inventive Example 13-2 and 13-3 contained 0.20 g (0.02 g net) or 0.60 g (0.06 g net) of Surfactant 10G as 10% solutions, respectively. Comparative Examples 13-4 and 13-5 contained 0.20 g (0.02 g net) or 0.60 g (0.06 g net) Masurf® FP-320 as 10% solutions, respectively. The finished solutions were 17.9 solids for Examples 13-2 and 13-4, and 18.0% solids for Examples 13-3 and 13-5.

The solutions were knife coated and ink jet printed upon as described in Example 8. In all, 5 samples were prepared. The weight ratio of inorganic particles to polymer was 94:6.

Samples were imaged as described above. TABLE XVII describes the weight percent of the surfactants added to each coating, the type of surfactants added to the image-receiving layer, and the fraction of the density patch wet 5 seconds after the completion of printing.

The data in TABLE XVII demonstrates that addition of 0.27% or 0.80 wt % Surfactant 10G to the image-receiving layer improved the drying time of the black ink patch that was measured at a transparent optical density of 3.1. The addition of 0.27% Masurf® FP-320 to the image-receiving layer did not improve the drying time of the black ink patch at a transparent optical density of 3.1. The addition of 0.80% Masurf® FP-230 was not coated as the image-receiving layer formulation coagulated before coating.

TABLE XVII

| Sample# | Description | Surfactant Placement | Surfactant 10G (wt %)* | Masurf ® FP-320(wt %)* | Percent of Patch Wet | Density of Wet Patch |
|---|---|---|---|---|---|---|
| 13-1 | Comparative | — | — | — | 100*** | 3.1 |
| 13-2 | Inventive | Image-receiving layer | 0.27 | — | 50 | 3.1 |
| 13-3 | Inventive | Image-receiving layer | 0.80 | | 12.5 | 3.1 |
| 13-4 | Comparative | Image-receiving layer | — | 0.27 | 100** | 3.1 |
| 13-5 | Comparative | Image-receiving layer | — | 0.80 | — | — |

*Weight percent of total solids in coating.
**In addition, 100 percent of the patch having the next lower optical density of 2.5 to 2.6 was wet.
***The patch having the next lower optical density of 2.5-2.6 was completely dry.

Example 14

The following example demonstrates the use of a surfactant in only the image-receiving layer. An under-layer was prepared as described in Example 1.

Preparation of Image-Receiving Layers

Ink-jet, image-receiving layers were prepared as described in Example 1. Comparative Examples 14-2 and 14-3 contained 0.40 g (0.04 g net) or 0.60 g (0.06 g net) Zonyl® FSN or Masurf® SP-320 as 10% solutions, respectively. The finished solutions were 18.0% for all Examples.

The solutions were knife coated and ink-jet printed upon as described in Example 8. In all, 3 samples were prepared. The weight ratio of inorganic particles to polymer was 94:6.

Samples were imaged as described above. TABLE XVIII describes the weight percent of the surfactants added to each coating, the type of surfactants added to the image-receiving layer, and the fraction of the density patch wet 5 seconds after the completion of printing.

The data, shown below in TABLE XVIII, demonstrates that addition of 0.54% Zonyl® FSN or 0.80% SP-320 to the image-receiving layer did not improve the drying time of the black ink patch at a transparent optical density of 3.1. Higher concentrations of SP-320 were not coated as the image-receiving layer formulation coagulated before coating.

TABLE XVIII

| Sample# | Description | Surfactant Placement | Zonyl FSN (wt %)* | Masurf ® SP-320 (wt %)* | Percent of Patch Wet | Density of Wet Patch |
|---|---|---|---|---|---|---|
| 14-1 | Comparative | — | — | — | 100*** | 3.1 |
| 14-2 | Comparative | Image-receiving layer | 0.54 | — | 100*** | 3.1 |
| 14-3 | Comparative | Image-receiving layer | — | 0.80 | 100*** | 3.1 |

*Weight percent of total solids in coating.
***The patch having the next lower optical density of 2.5-2.6 was completely dry.

Example 15

The following example demonstrates the use of a surfactant in only the image-receiving layer as well as in both the under-layer and the image-receiving layer.

Preparation of Under-Layer

Coating solutions were prepared by mixing 3.84 g of deionized water, 0.88 g of Celvol 203 poly(vinyl alcohol) as a 15% aqueous solution (0.132 g net), and 5.28 g of borax (sodium tetraborate decahydrate) as a 5% aqueous solution (0.264 g net). The ratio of borax to PVA was 67:33 (2:1) by weight. The coating solutions were knife coated at room temperature onto a 7 mil (178 micron) polyethylene terephthalate support. The coatings were air dried. The dry coating weight of the under-layer was 0.64 g/m$^2$. Comparative Example 15-1 and Inventive Example 15-2 were coated as described above. Inventive Examples 15-3 and 15.4 contained 2.00 wt % of Surfactant 10G. Inventive Examples 15-3 and 15-4 were prepared by adding 0.80 g of a 1.0% solution of Surfactant 10G to the coating solution described above.

Preparation of Image-Receiving Layers

A coating solution for the image-receiving layer was prepared by mixing 41.0 g of Disperal HP-14 (pH adjusted to 3.25 with 70% nitric acid) as a 20% aqueous solution (8.2 g net), and 7.13 g of Celvol 540 poly(vinyl alcohol) as a 10% aqueous solution (0.713 g net). The finished coating solution (Comparative Example 15-1) was at 17.9% solids. Additional inventive coating solutions were also prepared as described above but 0.60 g of Olin 10G was added to Examples 15-2, 15-3, and 15.4. The finished coating solutions were at 18.0%. The weight ratio of inorganic particles to polymer was 92:8.

The solutions were knife coated at room temperature onto the under-layers prepared above. Each solution was coated onto each of the under-layers. All coatings were dried in a forced air oven at 85° C. for 10 minutes. No mud-cracking was observed on the dried coatings. The, image-receiving layer was coated at 41 g/m$^2$ (using a 12.0 mil (305 micron) knife gap). In all, 4 samples were prepared.

Samples were imaged as described above. For these samples, printing was carried out at 50% to 55% relative humidity. TABLE XIX describes the weight percent of surfactant added to each coating, the type of surfactant added to the topcoat and the fraction of the density patch wet 5 seconds after the completion of printing.

The data, shown below in TABLE XIX, demonstrates that addition of 0.67 wt % Surfactant 10G to only the image-receiving layer, or addition of 2.00 wt % of Surfactant 10G to only the under-layer, or addition of 2.00 wt % of Surfactant 10G to the under-layer and 0.67 wt % of Surfactant 10G to the image-receiving layer improved the drying time of the ink patch that was measured at a transparent black density of 2.8 to 2.9.

The invention has been described in detail with particular reference to certain preferred embodiments thereof, but it will be understood that variations and modifications can be effected within the spirit and scope of the invention.

TABLE XIX

| Sample# | Description | Surfactant Placement | Surfactant 10G (wt %)* | Percent of Patch Wet | Density of Wet Patch |
|---|---|---|---|---|---|
| 15-1 | Comparative | — | — | 75 | 2.8 |
| 15-2 | Inventive | Image-receiving layer | 0.67 | 50 | 2.9 |
| 15-3 | Inventive | Under-layer | 2.00 | 50 | 2.8 |
| 15-4 | Inventive | Under-layer and Image-receiving layer | 2.00/0.67 | 12.5 | 2.9 |

*Weight percent of total solids in coating.

We claim:

1. An ink jet recording film comprising:

a transparent support;

an under-layer comprising a water soluble or water dispersible cross-linkable polymer containing hydroxyl groups, a borate, and optionally a surfactant; and an image-receiving layer coated over the under-layer comprising, a water soluble or water dispersible cross-linkable polymer containing hydroxyl groups, inorganic particles, and optionally a surfactant, wherein at least one of the under-layer or image-receiving layer includes a surfactant in an amount of at least 0.5 wt % when in the under-layer and at least 0.2 wt % when in the image-receiving layer, and further wherein the surfactant is a fluoroaliphatic polyacrylate fluoropolymer.

2. The ink-jet recording film of claim 1, wherein the transparent support comprises a polyester.

3. The ink jet recording film of claim 1, wherein the transparent support comprises polyethylene terephthalate.

4. The ink-jet recording film of claim 1, wherein the transparent support comprises a pigment, a dye, or a combination thereof.

5. The ink-jet recording film of claim 1 wherein the water soluble or water dispersible cross-linkable polymer containing hydroxyl groups in the under-layer comprises, poly(vinyl alcohol), partially hydrolyzed poly(vinyl acetate/vinyl alcohol), copolymers containing hydroxyethylmethacrylate, copolymers containing hydroxyethylacrylate, copolymers containing hydroxypropylmethacrylate, hydroxy cellulose ethers, or mixtures thereof; and the borate comprises sodium borate, sodium tetraborate, sodium tetraborate decahydrate, boric acid, phenyl boronic acid, butyl boronic acid, or mixtures thereof.

6. The ink jet recording film of claim 1 wherein water soluble or water dispersible cross-linkable polymer in the under-layer is present in an amount of from about 0.02 g/m$^2$ to about 1.8 g/m$^2$, the borate in the under-layer is present in an amount of from about 0.02 g/m$^2$ to about 2.0 g/m$^2$, and the surfactant is present in an amount of from about 0.001 g/m$^2$ to about 0.10 g/m$^2$.

7. The ink jet recording film of claim 1 wherein the water soluble or water dispersible cross-linkable polymer containing hydroxyl groups in the image-receiving layer comprises, poly(vinyl alcohol), partially hydrolyzed poly(vinyl acetate/vinyl alcohol), copolymers containing hydroxyethylmethacrylate, copolymers containing hydroxyethylacrylate, copolymers containing hydroxypropylmethacrylate, hydroxy cellulose ethers, or mixtures thereof;

the inorganic particles comprise fumed silica, fumed alumina, colloidal silica, or boehmite alumina, or mixtures thereof; and the borate comprises sodium borate, sodium tetraborate, sodium tetraborate decahydrate, boric acid, phenyl boronic acid, butyl boronic acid, or mixtures thereof.

8. The ink-jet recording film of claim 1 wherein the water soluble or water dispersible cross-linkable polymer containing hydroxyl groups in the image-receiving layer comprises a polyvinyl alcohol; the inorganic particles comprise at least 88 wt %; and the surfactant comprises at least 0.20 wt %.

9. The ink-jet recording film of claim 1 wherein water soluble or water dispersible cross-linkable polymer in the image-receiving layer is present in an amount of from about 1.0 g/m$^2$ to about 4.5 g/m$^2$, the inorganic particles in the image-receiving layer are present in an amount of from about 17 g/m$^2$ to about 48 g/m$^2$, and the surfactant is present in an amount of from about 0.04 g/m$^2$ to about 1.5 g/m$^2$.

10. The ink-jet recording film of claim 1 wherein the surfactant in the under-layer is present in an amount of from about 0.5 wt % to about 5.0 wt %, and the surfactant in the image-receiving layer is present in an amount of from about 0.2 wt % to about 3.0 wt %.

11. The ink jet recording film of claim 1 wherein the portion of the film having an optical density of at least 2.8 is substantially dry 5 seconds after the completion of printing.

12. The ink-jet recording film of claim 1 having a total haze of less than 24%.

13. The ink-jet recording film of claim 1 wherein the ratio of inorganic particles to cross-linkable polymer is between 88:12 and 95:5.

14. The ink-jet recording film of claim 1 wherein the ratio of inorganic particles to cross-linkable polymer is between 92:8 and 94:6.

15. The ink-jet recording film of claim 1 wherein the surfactant is present in only the image-receiving layer and in an amount of at least 0.2 wt %.

16. The ink-jet recording film of claim 1 wherein the surfactant is present in only the under-layer in and in an amount of at least 0.5 wt %.

17. The ink jet recording film of claim 1 wherein the surfactant is a perfluoromethylacrylic copolymer.

* * * * *